United States Patent [19]

Tanzawa et al.

[11] Patent Number: 4,931,840

[45] **Date of Patent: * Jun. 5, 1990**

[54] CLEANING DEVICE

[75] Inventors: Misao Tanzawa, Kawasaki; Shuichi Endo, Tokyo, both of Japan

[73] Assignee: Ricoh Company, Ltd., Tokyo, Japan

[ * ] Notice: The portion of the term of this patent subsequent to Aug. 30, 2005 has been disclaimed.

[21] Appl. No.: 372,117

[22] Filed: Jun. 28, 1989

Related U.S. Application Data

[63] Continuation of Ser. No. 167,298, Mar. 11, 1988, abandoned, which is a continuation of Ser. No. 924,830, Oct. 30, 1986, Pat. No. 4,768,062.

[30] Foreign Application Priority Data

Oct. 30, 1985 [JP] Japan ..... 60-241299
Oct. 30, 1985 [JP] Japan ..... 60-165786

[51] Int. Cl.[5] ..... G03G 21/00
[52] U.S. Cl. ..... 355/298; 355/299
[58] Field of Search ..... 355/296, 298, 299; 15/256.51, 256.52; 101/425

[56] References Cited

U.S. PATENT DOCUMENTS

| | | | |
|---|---|---|---|
| 3,742,551 | 7/1973 | Oriel | 355/299 X |
| 3,882,823 | 5/1975 | Tanaka et al. | 355/253 X |
| 3,950,092 | 4/1976 | Zoltner | 355/298 |
| 4,140,389 | 2/1979 | Franke et al. | 355/297 |
| 4,174,902 | 11/1979 | Hamaguchi | 355/246 |
| 4,768,062 | 8/1988 | Tanzawa et al. | 355/298 |

*Primary Examiner*—Fred L. Braun
*Attorney, Agent, or Firm*—Oblon, Spivak, McClelland, Maier & Neustadt

[57] ABSTRACT

A cleaning device includes a cleaning blade for scraping out toner from a photosensitive member and a polygonal member for carrying scraped toner into a toner container. A rotation center of a blade holder for supporting the cleaning blade is coincident with a rotation center of the polygonal member. The polygonal member is composed of a plurality of sections arranged along an axis thereof. At least one of the sections has ridgelines which are shifted from those of the remaining sections.

2 Claims, 8 Drawing Sheets

CLEANING DEVICE

This application is a continuation of application Ser. No. 07/167,298, filed on March 11, 1988, now abandoned, which is a continuation of application Ser. No. 924,830, filed October 30, 1986, now U.S. Pat. No. 4,768,062.

FIELD OF THE INVENTION

The present invention relates to a cleaning device having a cleaning blade for sweeping toner left on an image carrier away, a rotatable blade holder for supporting the cleaning blade and a polygonal member rotatable to carry toner scraped by the cleaning blade to a recovered toner reservoir.

RELATED ART STATEMENT

Such cleaning device as mentioned above is well known and used in an electrophotographic copying machine, a printer and a facsimile apparatus. Since the cleaning device of this type uses the cleaning blade, it is advantageous, in size, manufacturing cost and handling, over cleaning devices of other types. Among the preferable type cleaning devices which use the cleaning blades, one having the blade which contacts with a photosensitive member on a trailing side of a rotational direction of the member provides a stable performance of operation and increases the possibility of minimizing the size of the device.

In such device, the cleaning blade may be always in contact with the photosensitive member. In such case, it is advantageous in structure and manufacturing cost over the device of the type in which the contact of the blade with the photosensitive member is controlled in synchronism with the movement of the member. However, since the cleaning blade is of polyuretane rubber, etc., a resiliency thereof is degraded when it is made always in contact with the photosensitive member. Therefore, in the continuous contact system, it is advantageous to minimize a contact pressure of the cleaning blade to the photosensitive member. In this case, however, the blade tends to be separated from the photosensitive member at a time when the photosensitive member starts to move. This may degrade the cleaning performance.

In order to overcome this problem, it is desired to make a rotation center of the cleaning blade, i.e., a fulcrum of the holder, as close to the side of a tangential line at a contact point of the blade with the photosensitive member as possible. However, since, in the cleaning device of the type in which a polygonal member is used to move recovered toner, the polygonal member 302 has to be positioned below the contact point between the cleaning blade 300 and the photosensitive drum 301, the fulcrum 304 of the blade holder 303 is located apart from the drum, as shown in FIG. 1. Therefore, in the conventional device, either a shortened life of the blade or a degradation of cleaning performance has to be accepted.

Furthermore, in the cleaning device of the type, a recovering blade member 322 of nylon polyster etc. is provided usually in the left side of the polygonal member 321, which rotates clockwisely, such that the blade member 322 is in contact with the polygonal member 321 longitudinally thereof, as shown in FIG. 2. With this arrangement, toner T existing in the vicinity of a ridgeline of the polygonal member 321 is successively scraped by the blade member 322 and is pushed into the reservoir such as a hopper (not shown) along the blade member 322.

In the cleaning device having such toner carrying mechanism, the blade member 322 is bent by the polygonal member 321 up to a position on a circumcircle 324 of the polygonal member 321 when the ridgeline of the polygonal member 321 passes over the contact point of the blade member 322, as shown by an imaginary line in FIG. 2, at which time a drive means for driving the polygonal member 321 provides a peak torque. Such torque may be no problem in an initial stage in which the thin blade member 322 is sufficiently flexible.

However, when the hopper becomes filled with toner with time, it becomes a load against the bending of the blade member, resulting in an abrupt increase of the peak torque. When such condition continues, the drive means may be pulsated which influences an image adversely and/or chick sound produced by a collision of the blade member to the polygonal member may be increased due to pulsated operations of various components driven by the same drive means. When the peak torque increases further, there may be a breakage of a portion of the hopper, the blade member and/or the drive means, particularly, a transmission mechanism therefor.

In order to overcome this problem, it has been proposed to increase the driving power and to improve the transmission system, correspondingly to the increased peak torque. As another approach, it has been also proposed to provide a toner detector in the hopper to detect the peak torque before toner therein is increased over a predetermined amount so that the cleaning device can be replaced, etc.

However, the former method is disadvantageous in that a cost therefor is very high and the latter is disadvantageous in that the detector to be used must be of high sensitivity and the whole device must be replaced before the hopper is fully filled with the toner.

SUMMARY OF THE INVENTION

An object of the present invention is to provide a cleaning device by which a satisfactory cleaning performance is obtained, even if the contact pressure of the cleaning blade to the image carrier is minimized, without degrading the toner recovery.

Another object of the present invention is to provide a cleaning device in which the peak torque of the drive means for driving the polygonal member is restricted even if the toner hopper is fully filled with the toner.

Another object of the present invention is to make the rotation center of the blade holder supporting the cleaning blade coincident with the rotation center of the polygonal member.

A further object of the present invention is to displace the ridgelines of the polygonal member.

DETAILED DESCRIPTION OF PREFERRED EMBODIMENTS

The embodiment corresponds to a case where the present invention is applied to an electrographical copying machine.

Figure 3:
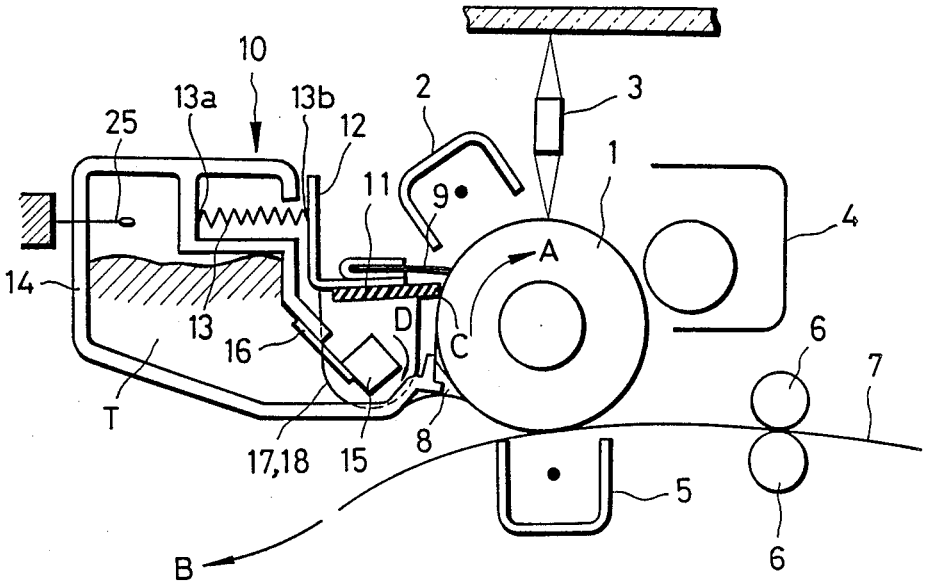
FIG. 3 shows a copying machine in which the present cleaning device is used, schematically.

In FIG. 3, a photosensitive drum 1 is rotatably supported by a frame of a copying machine which is not shown. When the drum 1 is rotated in an arrow direction A by a drive means (not shown), a surface of the drum is charged by a charging portion 2 and an electrostatic latent image is formed on a charged region by an image exposure performed by an exposing portion 3. When the latent image passes through a developing portion 4, toner adheres thereto to make it visible, and then the visible image is fed to a transfer portion 5. Into the transfer portion 5, a transfer paper 7 is also fed through a register roller 6 in synchronism with the visible image, on which the visible image is transferred thereto. The transfer paper 7 having now the visible image is peeled off from the photosensitive drum 1 by a separating nail 8 and carried in a direction B, through a fixing portion outwardly of the machine. It is unavoidable that some toner is left on the drum surface after the transfer. The residual toner is cleared by the cleaning device 10 according to the present invention. The photosensitive drum 1, after being cleaned, is discharged by a charge removing brush 9 in preparation for the next copying operation. According to the present invention, a cleaning blade 11 is in a line contact with the drum 1 throughout its width such that it is trailed by the drum 1 with its rotation. That is, the blade 11 is in contact with the drum 1 at a point C with a blade body thereof having a tilting angle on an upstream side of the rotating direction A of the drum 1. The cleaning blade 11 is formed of a resilient material such as polyuretane rubber and secured to a blade holder 12 by, for example, an adhesive. The holder 12 is rotatably mounted on a hopper 14, as mentioned later. A reference numeral 13 depicts a spring for biasing the blade 11 to the photosensitive drum 1.

Figure 5:
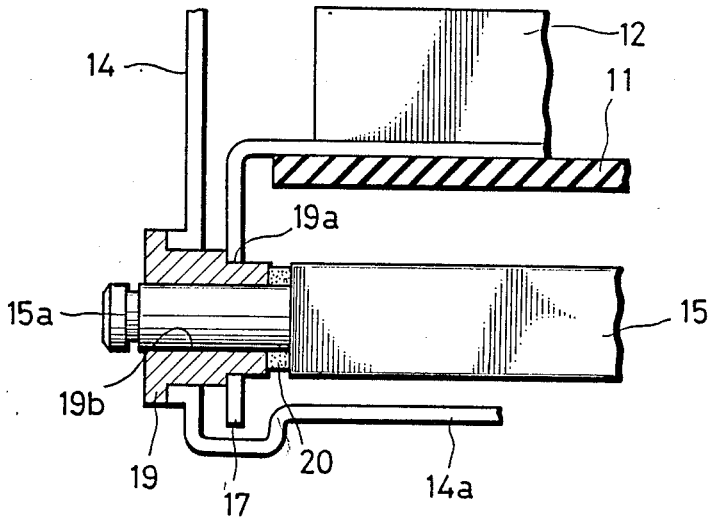
FIG. 5 is a cross section showing a portion in FIG. 4, after being assembled.

A polygonal member 15 is provided below the blade 11, for carrying toner T scraped off from the drum 1 by the blade 11 to a toner storage container in the form of a hopper 14. The polygonal member 15 is formed of a material such as aluminum and has substantially a square cross section. A recovery blade 16 formed from a polyester film is made to contact with the polygonal member 15 throughout its length. The member 15 is rotated in an arrow direction D by a drive means which is not shown so that toner adhered to the member 15 is scraped by the blade 16. It should be noted that the cross sectional shape of the polygonal member is not limited to a square, it may be rectangular, triangular or pentagonal, etc. Since the transfer paper having an image not yet fixed passes below the cleaning device 10, the hopper 14 is recessed (14*a*) in its bottom to allow the passage of the transfer paper as shown in FIG. 5.

In the present cleaning device 10, the rotation center of the holder 12 is made coincident with the rotation center of the polygonal member 15 and so the rotation center of the cleaning blade 11 is arranged in the vicinity of a tangential line of the cleaning blade 11 at the contact point C. Therefore, if the force given by the spring 13 is minimized to reduce the contact pressure of the blade 11 to the photosensitive drum 1, the cleaning performance thereof is still satisfactory. The reduction of the contact pressure attributes to a reduction of abrasion and hence an increase of blade life.

Further, since it is possible to arrange the polygonal member 15 below the pressure contact point of the blade 11 to the photosensitive drum 1, there is no degradation of the toner recovering performance.

Embodiments in which the rotation centers of the cleaning blade 11 and the polygonal member 15 are coincident will be described.

Figure 4:
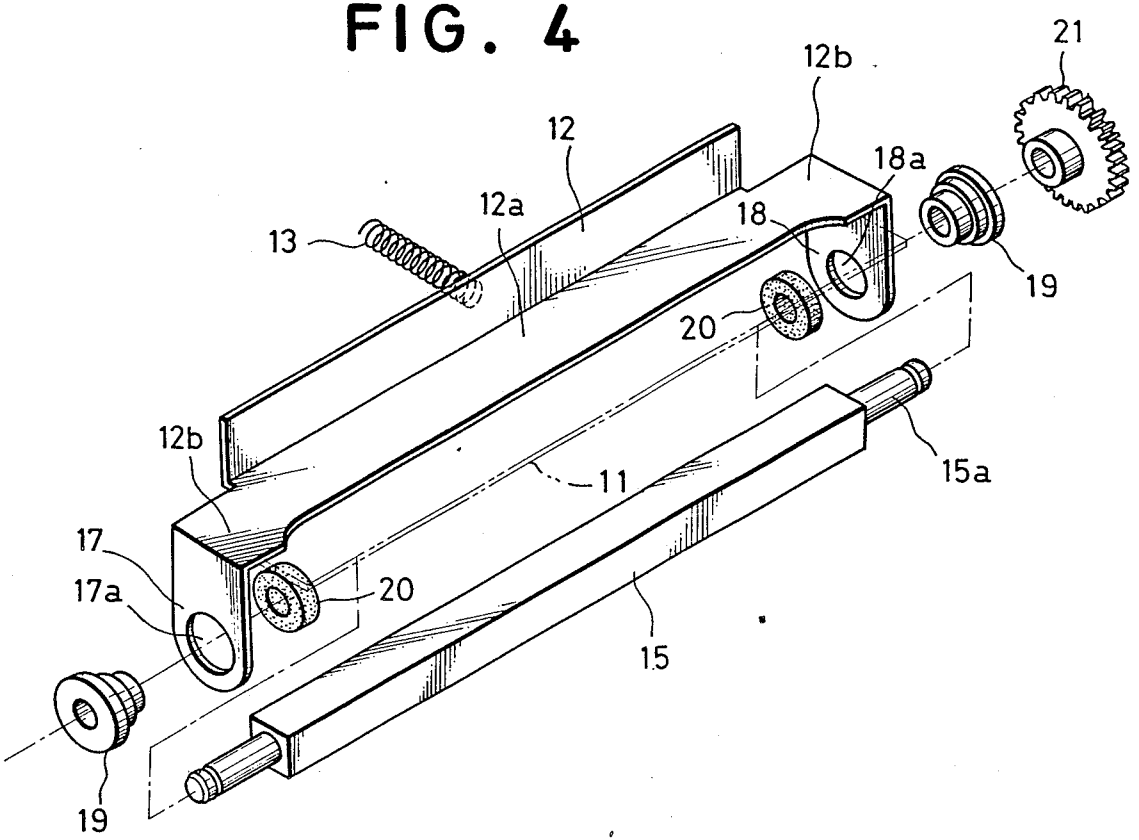
FIG. 4 is a disassembled, perspective view of a portion of FIG. 3.
Figure 6:
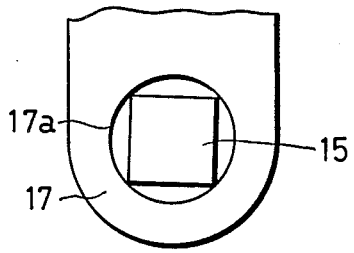
FIG. 6 is a side view of the portion in FIG. 5.

In FIGS. 4 and 5, the blade holder 12 is formed integrally at both ends thereof with legs 17, 18, respectively, which have holes 17*a* and 18*a* in which bearings 19 are fitted, respectively. In this case, at least one of the holes 17*a* and 18*a* has a diameter slightly larger than a circumcircle of the polygonal member 15, as shown in FIG. 6. The bearings 19 to be fitted in the holes 17*a* and 18*a* are fixed to the hopper 14 as shown in FIG. 5 such that reduced diameter portions 19*a* thereof rotatably support the blade holder 12 and have through holes 19*b* in which a rotary shaft 15*a* is supported. A reference numeral 20 depicts a sealing of sponge for preventing toner from coming around along the rotary shaft 15*a* of the polygonal member 15 and 21 is a gear for transmitting a drive force of the drive means (not shown).

Thus, the axis of the polygonal member 15 is coincident with the axis of the holes 17*a* and 18*a* of the legs 17 and 18 and hence the rotation center of the blade holder 12.

Figure 2:
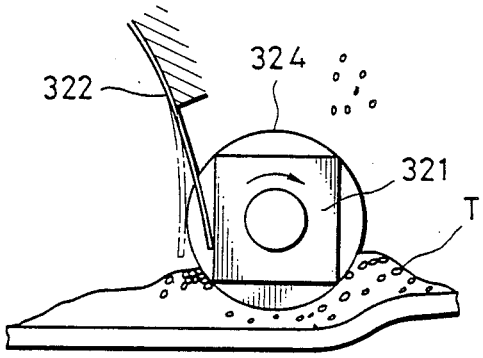
FIG. 2 (PRIOR ART)
FIG. 2 illustrates an operation of a conventional toner recovering device.

With this arrangement, the cleaning performance is not degraded even if the contact pressure of the blade 11 to the drum 1 is reduced, resulting in an increased blade life as mentioned previously, and, further, it is effective in reducing the size of the cleaning device 10. In the case shown in FIG. 2, in which the single spring is arranged at a center of the blade holder 12 to bias the blade to the drum 1, it is important to locate the spring in the exact center position of the holder 12. Since, in this embodiment, the polygonal member 15 penetrates the center shaft, it is possible to locate the spring at the center position accurately.

A portion 12*a* of the blade holder 12 by which the cleaning blade 11 is supported has a reduced width comparing with opposite end portion 12*b* thereof. The end portions 12*b* having larger width are effective in reinforcing opposite end portions of the cleaning blade 11 while increasing mechanical strength of the blade holder 12.

Further, it is possible to shorten the legs 17 and 18, relatively, which is advantageous in rigidity of the holder.

The present invention removes a problem that, when the photosensitive drum 1 is removed from the copying machine for maintenance, toner tends to flow out through opposite openings of the cleaning device.

Figure 7:
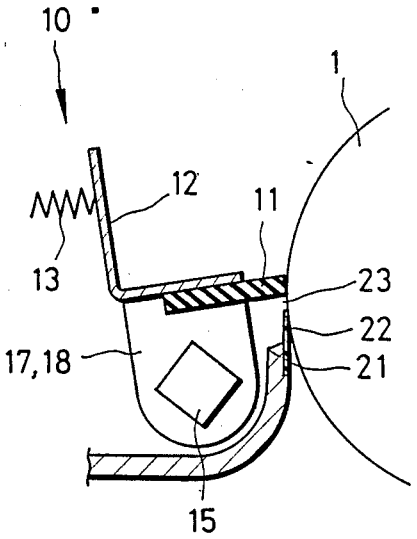
FIG. 7 is an enlarged sectional view of a portion in FIG. 3.
Figure 8:
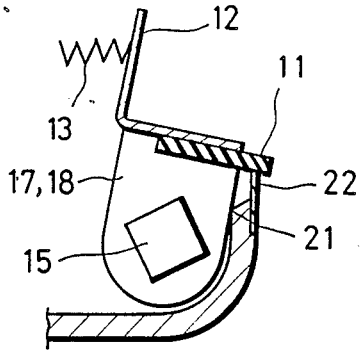
FIG. 8 is a cross section of the structure in FIG. 7, with the photosensitive drum being removed.

In FIG. 7, an inlet seal 22 of polyester film is provided in the side of the cleaning device 10 facing to the photosensitive drum 1 and an opening 23 of about 2 mm is provided between the blade 11 and the top end of the inlet seal 22. When the drum 1 is removed from the copying machine, the blade holder 12 is rotated by the spring 13 about the axis of the polygonal member 15, the rotation range being limited by a contact of the legs 17 and 18 with a stopper 21 provided on the hopper 14. When a position of the stopper 21 is selected such that it corresponds substantially to a position in which the cleaning blade 11 contacts with the inlet seal 22, as shown in FIG. 8, the opening 23 is closed by the cleaning blade 11 and the inlet seal 22 when the drum 1 is removed. Therefore, it is possible to prevent the flow-out of toner from the cleaning device.

Figure 9:
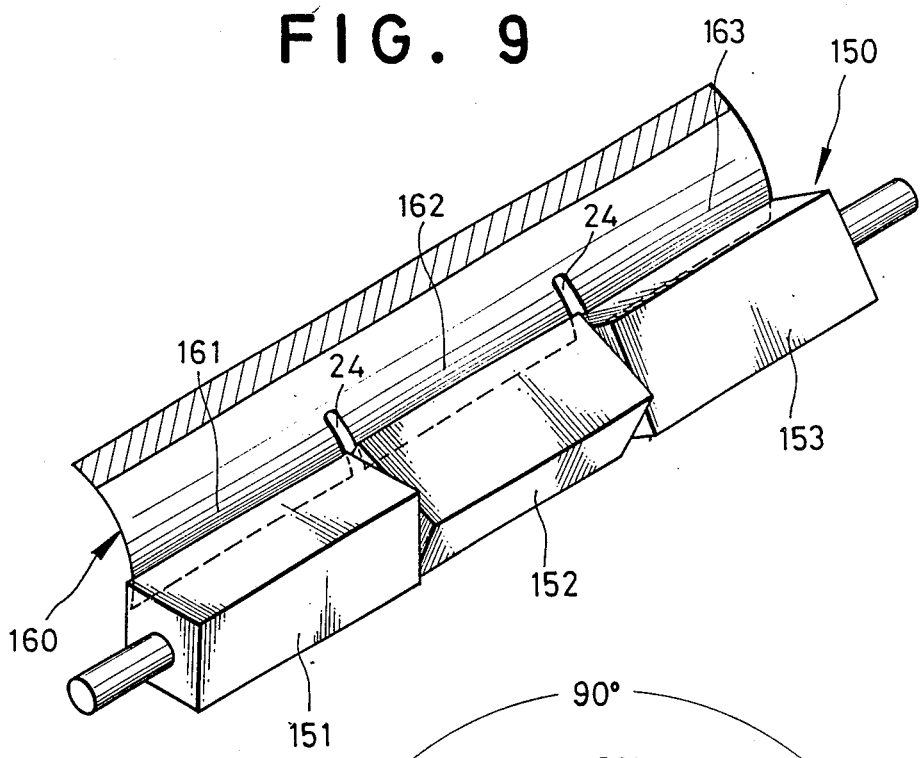
FIG. 9 is a perspective view of the polygonal member and the recovery blade according another embodiment of the present invention.
Figure 10:
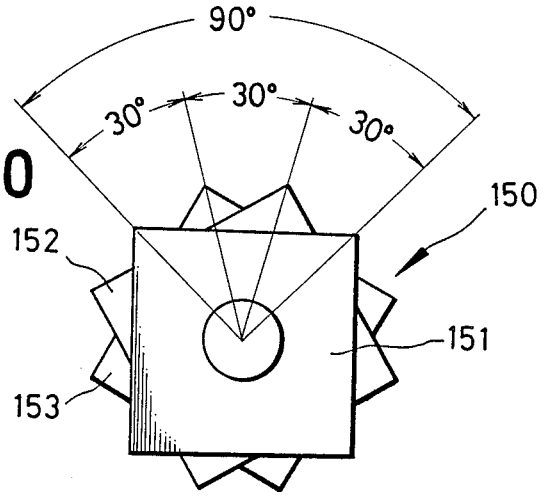
FIG. 10 is a side view of the polygonal member in FIG. 9.

According to the present invention, the previously mentioned problem of the increasing of peak torque of the drive means due to the accumulation of toner T in the hopper 14 is overcome by a provision of mechanism which is shown in FIGS. 9 and 10.

In FIGS. 9 and 10, a polygonal member 150 is sectioned into a plurality of sections (in this embodiment, three sections 151, 152 and 153) which are connected coaxially with a predetermined angle between adjacent ridgelines. In this embodiment, the angle is about 30° as shown in FIG. 10. A recovery blade 160 which is made in contact with the polygonal member 150 is formed, in the contacting side thereof, with notches 24 at positions corresponding to connecting portions of the member 150, respectively, so that the blade 160 is substantially divided into three sections 161, 162 and 163. Therefore, the blade sections 161, 162 and 163 can contact with the polygonal member sections 151, 152 and 153, independently, respectively. Thus, it is possible to scrape toner T on the sections 151, 152 and 153.

In FIG. 3, a reference numeral 25 depicts the detection switch for detecting toner in the hopper 14 and, preferably, a piezo element.

In the cleaning device 10 constituted in this manner, toner T scraped from the photosensitive drum 1 by the cleaning blade 11 is pushed by the rotating polygonal member 150 to the latter, scraped therefrom around the ridgelines thereof by the blade 160 and pushed up into the hopper 14. The load of the drive means which increases with the rising level of toner in the hopper and which corresponds to the bending force acting on the recovery blade 160 is distributed over the three, relatively independent blade section 161, 162 and 163 associated with the sections 151, 152 and 153 of the polygonal member 150, respectively. It has been found that the peak torque is reduced to one-third to a half of the conventional case and, with such reduction, the rotation of the polygonal member 150 is relatively smooth and noise is not increased.

The peak torque was measured by using the cleaning devices having the polygonal members 150 and 15 shown in FIG. 9 and FIG. 4, respectively.

Figure 11:
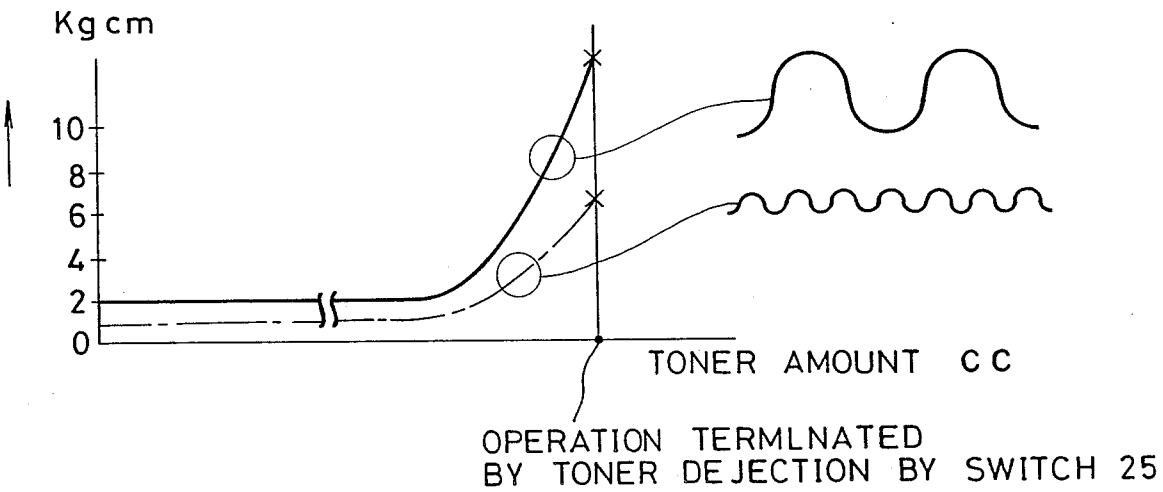
FIG. 11 is a graph showing a relation between the amount of recovered toner and the torque of drive means when the polygonal member shown in FIGS. 4 and 9 are used, respectively.

Results are shown in FIG. 11 in which the torque and the amount of toner recovered are depicted in ordinate and abscissa, respectively, and in which the result of the device in FIG. 9 is shown by a chain line and that of the device in FIG. 4 is shown by a solid line. As is clear from FIG. 11, the peak torque of the device having the polygonal member 150 in FIG. 9 is about a half of that of the device having the polygonal member 15 in FIG. 4. The pulsation of the torque is shown in a right side of FIG. 11. As is clear from the waveforms, the mechanical vibration of the constitutional components of the device shown in FIG. 9 is much reduced by the polygonal member 150 and other components associated therewith and thus the possibility of damage of the drive means and associated transmission system is much reduced.

It should be noted that the number of divisions of the polygonal member is not limited to three and any number of sections can be employed with corresponding angles between adjacent ridgelines thereof and corresponding number and positions of the notches of the recovery blade. It is further possible to uniformly twist the single polygonal member or twist it locally so that a plurality of straight portions are provided with a twisted portion between adjacent straight portions. In the case of the uniformly twisted member, a number of the notches or slits should be provided in the recovery blade and, in the case of the locally twisted member, a slit should be provided at each twisted portion.

As mentioned previously, when the hopper 14 is filled with toner T completely, the switch 25 detects it upon which the situation is informed to the operator by means of, for example, a warning lamp and the operation of the associated components is terminated. In this case, there is a possibility that the hopper 14 is broken by recovered toner T before the switch 25 detects the fully filled condition thereof. Therefore, it is necessary for the switch 25 to detect reliably the fully filled condition before the breakage of the hopper.

Figure 12:
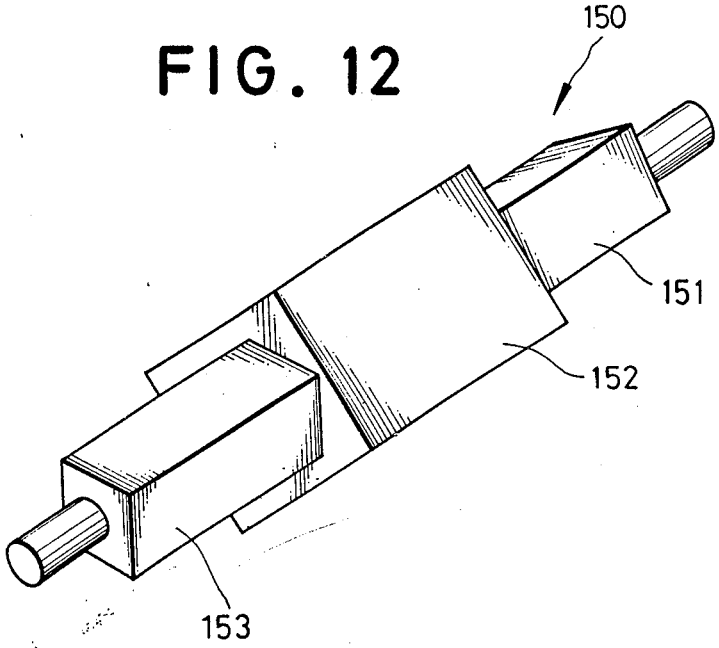
FIG. 12 is a perspective view of a modification of the polygonal member.
Figure 13:
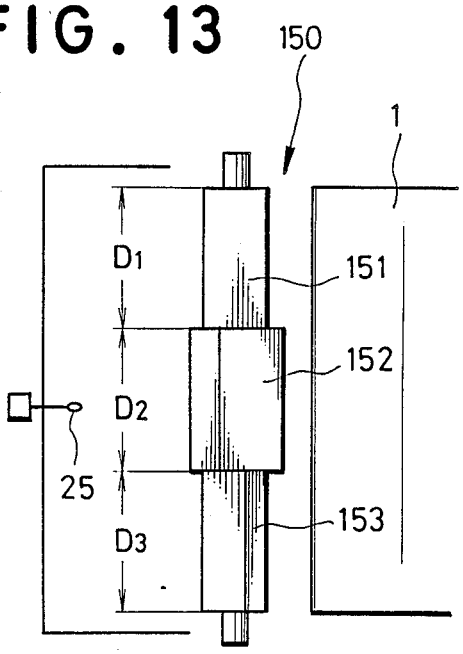
FIG. 13 illustrates a positional relation between the polygonal member in FIG. 12 and a detection switch.

In order to overcome this problem, it is enough to constitute the hopper such that a portion thereof in which the switch 25 is located is firstly filled completely with toner T and other portions thereof are filled completely thereafter. To this end, according to the present invention, the switch 25 is located in a center region $D_2$ in the longitudinal direction of the photosensitive drum 1 as shown in FIG. 13 and the size of the center section 152 of the polygonal member 150 is made larger than the side sections 151 and 153 as shown in FIGS. 12 and 13.

With such construction, the amount of toner to be recovered by the center section 152 becomes larger than that recovered by the side sections 151 and 153. Therefore, the center region $D_2$ of the hopper 14 is filled with toner earlier compared with side regions $D_1$ and $D_3$ and, thus, the switch 25 can detect the fully filled condition before the hopper is broken.

As another method for locally increasing the amount of toner in the hopper 14, it is possible to make the blade portion of the recovery blade 160 correspond to a specific region of the hopper, for example, the blade portion 162 in the case where the specific region is the center region, more stiff than the other blade portions 161 and 163, or to make the portion 162 shorter than others so that the toner scraping amount thereof is increased locally.

Figure 14:
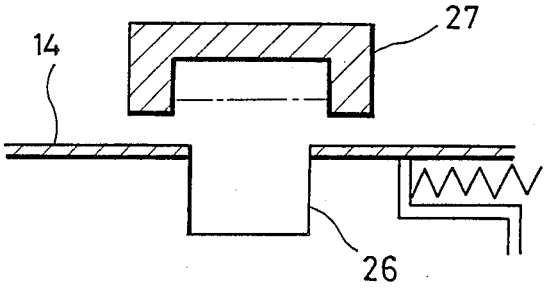
FIG. 14 shows a modification of the detection switch.
Figure 15:
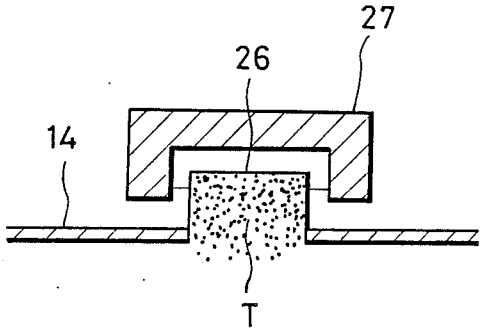
FIG. 15 illustrates a condition established when it detects that toner is full.

The switch 25 is not limited to the piezo element, for example, instead of the switch 25 a detection means shown in FIG. 14 can be also used. The detection means in FIG. 14 is composed of a circular hole formed in an upper portion of the hopper 14 and a flexible membrane 26 disposed so as to cover the circular hole. The membrane 26 is of a transparent material such as acrylic resin and is adapted to allow a partial rising of the level of toner T in the hopper through the hole when it is full. A permeable type sensor 27 is disposed above the hole, which detects the membrane 26 pushed up by toner as shown in FIG. 15. It may be possible to provide a vertically extending feeler at a center of the membrane 26 so that the feeler is detected by the sensor 27 when the membrane 26 is pushed up.

Figure 1:
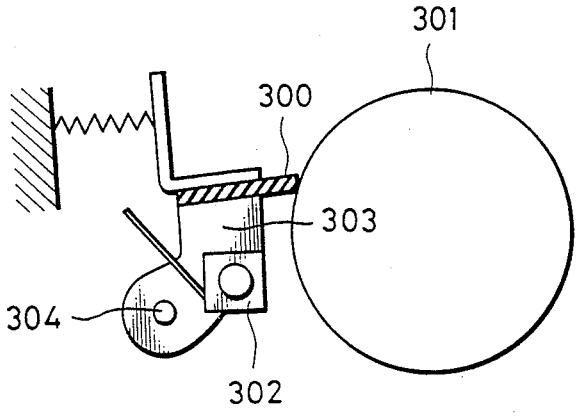
FIG. 1 (PRIOR ART)
FIG. 1 illustrates a conventional cleaning device schematically.

In the cleaning device 10 described hereinbefore, the photosensitive drum 1, after residual toner is removed thereby, is discharged by the charge removing brush 9. The brush 9 is disposed on an upper portion of the blade holder 12 as shown in FIG. 1 and is applied with a biasing voltage. In this case, the biasing voltage may be supplied from one end 13*a* of the coil spring 13. In such case, at least a portion of the blade holder 12 between a position with which the other end 13*b* of the spring 13 contacts and a position in which the brush 9 is disposed should be formed of electrically conductive material.

With such construction in which the brush 9 is provided on the blade holder 12 of the cleaning device 10 and the biasing voltage is applied through the spring 13 thereto, the application of biasing voltage is facilitated without affecting the pressure of the spring 13 adversely.

What is claimed is:

1. A cleaning device comprising a cleaning blade adapted to be in contact with an image carrier on the trailing side thereof for removing residual toner on a surface of said image carrier, a rotatable blade holder for supporting said cleaning blade and a polygonal member rotatable for moving toner scraped from said surface of said image carrier to a toner recovery means comprised by a toner carrier, said polygonal member composed of a plurality of sections arranged along an axis thereof, at least one of said sections having ridgelines shifted from those of the remaining sections.

2. A cleaning device as claimed in claim 1, further comprising an inlet seal adapted to be in contact with a surface of said image carrier, an opening formed between said cleaning blade and a top end of said inlet seal and a spring biasing said cleaning blade to said image carrier, said blade holder being rotated by the biasing force of said spring and said opening being closed by contacting of said cleaning blade with said inlet seal when the image carrier is removed from the cleaning device.

* * * * *